United States Patent [19]

Gueret

[11] 4,294,410

[45] Oct. 13, 1981

[54] CLOSING DEVICE, WITH A TILTABLE NOZZLE, FOR A PRESSURIZED CONTAINER

[75] Inventor: Jean-Louis Gueret, Paris, France

[73] Assignee: L'Oreal, Paris, France

[21] Appl. No.: 114,260

[22] Filed: Jan. 22, 1980

[30] Foreign Application Priority Data

Feb. 28, 1979 [FR] France ..... 79 05192

[51] Int. Cl.[3] ..... B65D 83/14

[52] U.S. Cl. ..... 239/577; 222/402.21; 239/590.5

[58] Field of Search ..... 222/402.21, 402.23; 239/337, 343, 344, 573, 577, 590.3, 590, 590.5

[56] References Cited

U.S. PATENT DOCUMENTS

| | | | |
|---|---|---|---|
| 2,974,880 | 3/1961 | Stewart et al. | 239/590 X |
| 2,975,944 | 3/1961 | Michel | 222/402.23 |
| 3,759,427 | 9/1973 | Stanley et al. | 222/402.23 |

FOREIGN PATENT DOCUMENTS

| | | | |
|---|---|---|---|
| 1775974 | 4/1973 | Fed. Rep. of Germany | 239/577 |

*Primary Examiner*—Andres Kashnikow

*Attorney, Agent, or Firm*—Brisebois & Kruger

[57] ABSTRACT

A device for closing a pressurized container but for allowing controlled dispensing of liquid contents of the container, in finely divided form or as a foam, has a cap 4 consisting of a fixed part 8, 10, 13 to be mounted on the neck 2 of a container 1 and a movable part comprising a dispensing nozzle 11 connected to the fixed part by way of a waisted deformable wall portion 15. An obturator member 7 inside the cap and nozzle has a mounting plug *7a* at its inner end and a ribbed obturator part *7c* at its outer end. The seal between the obturator member and the dispensing nozzle is formed by an externally concave zone *7b* of the obturator member, conforming to the waisted portion 15 of the cap, such that lateral swinging of the dispensing nozzle 11 breaks the seal and forms a gap 19 into which the liquid product can flow by way of a longitudinal groove 16 of the mounting plug *7a.*

13 Claims, 2 Drawing Figures

CLOSING DEVICE, WITH A TILTABLE NOZZLE, FOR A PRESSURIZED CONTAINER

DESCRIPTION

Figure 1:
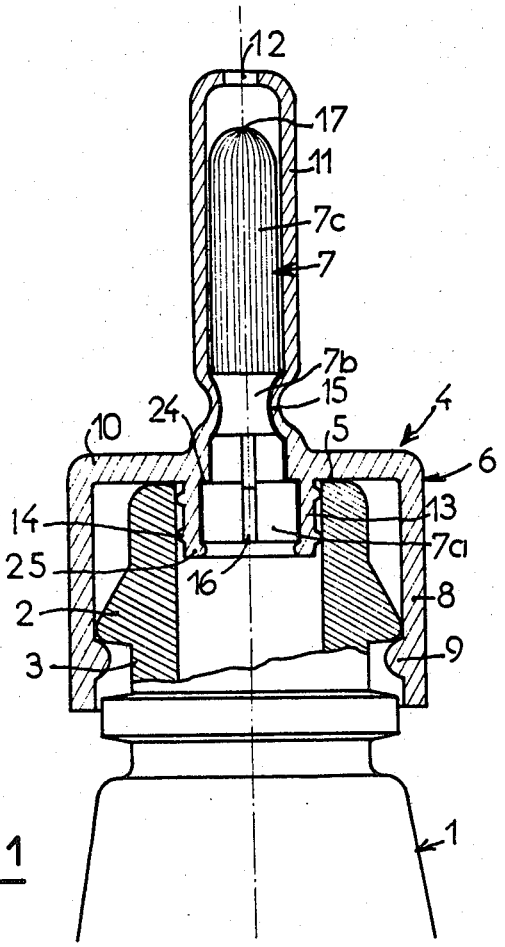

The present invention relates to a closing device for a pressurised container, the closing device having a tiltable nozzle through which the contents of the container can be dispensed, when desired. It is known that, in place of the usual discharge valves used with pressurised containers or aerosol cans, it is possible to provide a simplified closing device which is fixed onto the neck of the container by snapping-on.

In a known embodiment of such a closing device there are two interlocking pieces namely, on the one hand, a dispensing cap made of an elastic material and, on the other hand, obturating means located inside the dispensing cap. The dispensing cap comprises a fixed part fastened to the container and a movable part articulated on the fixed part and consisting of a dispensing nozzle projecting outside the container. In this form of the device the articulation of the nozzle consists of an elastically deformable annular shoulder which joins the nozzle to a skirt and the skirt is provided with means for snapping-on it on a container neck in order to ensure the fixing of the cap to the container neck. The obturating means consists of an actuating rod located inside the dispensing nozzle, and of an obturator member which is elastically pressed against a seating formed by the neck of the container. If the dispensing nozzle is tilted perpendicular to its axis the actuating rod also tilts, and this makes it possible to raise the obturator member from its seating so that the system is no longer leaktight and product is thus dispensed. When the dispensing nozzle is released, it resumes its original position and the obturator member re-closes the neck of the container.

A closing device of this kind is intended for dispensing liquid substances, for example those used in cosmetics, in a divided form or in the form of a foam, from a container which is pressurised by means of a conventional type of propellant fluid. Propellant fluids which may be mentioned are halogenoalkanes known under the name "Freon", or liquefied hydrocarbons such as butane or propane, or compressed gases such as for example carbon dioxide or nitrous oxide, which may be capable of dissolving at least partially in the packaged liquid.

However, a closing device with a tiltable nozzle exhibits the disadvantage that the neck of the container constitutes the seat of the obturator member, so the closing device cannot be fixed to all existing types of container; in fact, it is essential not only for the internal diameter of the container neck to be of the appropriate size, but also for the rim of the neck constituting the seating of the obturator member to have a sufficiently planar surface to enable a good seal to be formed.

The object of the present invention is to overcome the above-mentioned disadvantage.

Accordingly the present invention provides a closing device intended to be fixed to the neck of a container, such closing device consisting of an obturator member and a dispensing cap which is made of an elastically deformable material; wherein the dispensing cap comprises a fixed part which is adapted to be fastened to the neck of a said container, and a further part which is movable relative to the fixed part and constitutes a dispensing nozzle projecting outside the container, the said nozzle being provided with at least one orifice at the free end of the nozzle and with an axial channel connecting that end of the dispensing cap which is intended to face the internal volume of the container with said at least one discharge orifice; wherein said obturator member is a body of elongate shape of an elastically deformable material having one of its ends secured to the said fixed part of the dispensing cap and/or with the neck of the container, and an externally concave intermediate zone between its ends towards the outside; and wherein the dispensing nozzle is joined to said fixed part of the dispensing cap by means of a deformable peripheral wall zone which surrounds the obturator member and which only forms a seal with the said obturator member in the intermediate zone of the said member when the nozzle is not so tilted, at least part of the obturator member housed inside the said axial channel in the nozzle so that the dispensing operation can be carried out by tilting the nozzle about a transverse axis.

The obturator member is in the present invention elastically deformable material at its externally concave intermediate zone, and is fixed at one of its ends to the container neck and/or to the fixed part of the dispensing cap so as to locate the externally concave zone within the deformable peripheral wall zone which then defines the articulation zone of the nozzle and is pressed in a leaktight manner around the obturator member to seal the container. Thus closure is, in accordance with the present invention, provided by cooperation of the obturator member with the actual wall of the nozzle and not, as in the prior art device, with the rim of the neck. When the user tilts the dispensing nozzle, the obturator member therewithin can bend by virtue of its elastic structure and in its bent part the wall zone of the nozzle which previously formed the seal is pulled away. The liquid packaged in the container can then be dispensed while the user holds the dispensing nozzle tilted.

In a preferred embodiment of this invention, the dispensing cap is in the form of a cylinder of revolution whose axis is substantially identical to that of the neck of a said container when the cap is fixed to the neck. The dispensing nozzle is in the form of a glove finger and the said at least one discharge orifice is made in the tip of the latter. In its deformable peripheral wall zone which forms the seal, the dispensing nozzle has a narrow cross-section of smaller diameter, which engages in a peripheral groove of corresponding shape formed in the obturator. In its peripheral zone which forms the seal the dispensing nozzle has a wall thinner than the remainder of its wall zone which does not form a seal. The peripheral groove made around the obturator member is in the shape of a rounded curve whose maximum depth is small relative to the axial distance which separates the two peripheral edges of the said groove. The fixed part of the dispensing cap comprises an external skirt to be fixed around the neck of the container by snapping-on, the above-mentioned external skirt being joined to the dispensing nozzle by means of an annular shoulder which in use may bear against the neck of the container. The said deformable peripheral wall zone of the nozzle is located near this annular shoulder and will fit around the outside of the neck of the container. At one of its ends, the obturator member is provided with a mounting plug which has a cross-section larger than that of the rest of the obturator member and is pressed into an internal skirt of the dispensing cap, the said internal skirt being intended to bear on the internal wall of the neck of the container. The internal and external skirts of the dispensing cap are substantially coaxial. At least one deformable peripheral lip to provide the seal between the container neck and the internal skirt, is provided in relief on the external wall of the said internal skirt. The mounting plug of the obturator member is provided with at least one groove extending parallel to its axis, the said groove opening at one of its ends at the end of the obturator member nearer the inside of the container, and at its other end into the peripheral groove defined by the externally concave intermediate portion of the obturator member. That part of the obturator member which extends from the said peripheral groove to its free end located near the discharge orifice is provided with ribs extending parallel to the axis of the said member, the diameter of the obturator member measured across the tops or addenda of the ribs, being essentially equal to the internal diameter of the surrounding wall portion of the nozzle.

The present invention also provides a pressurised container making it possible to package and to dispense a liquid product, in particular in a divided form or in the form of a foam, this pressurised container having the above defined closing device fixed on its neck.

Figure 2:
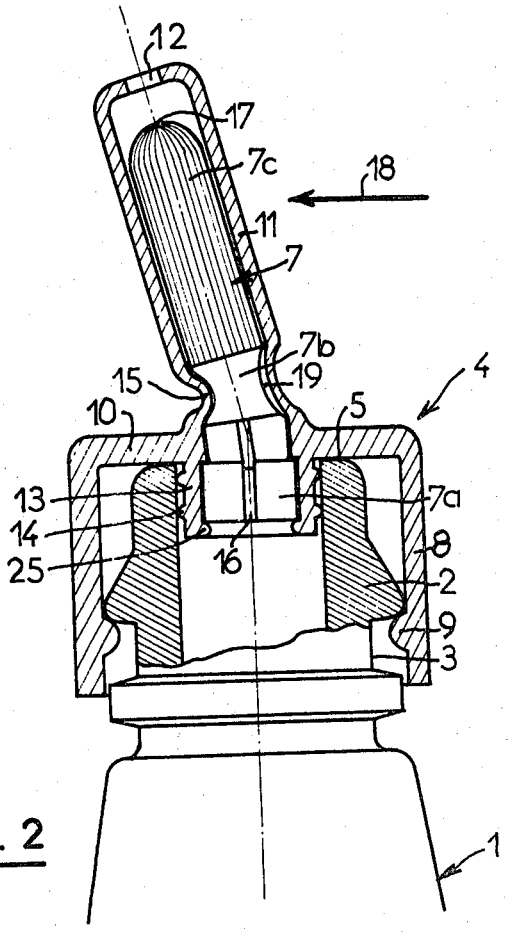

In order to provide a better understanding of the present invention one embodiment thereof will now be described, merely by way of a purely illustrative and non-limiting example, with reference to the accompanying drawings, in which:

FIG. 1 shows, in axial section, the upper part of a pressurised container on which a closing device according to the invention is fitted; and FIG. 2 shows, in axial section, the pressurised container, and the closing device of FIG. 1, at the moment when the dispensing nozzle is tilted.

The drawings show a pressurised container 1 containing a liquid product which it is desired to dispense in a divided form or in the form of a foam. The container 1 is pressurised in the conventional manner, by means of a propellant fluid such as for example a chlorofluoroalkane product known as "Freon".

The container 1 is provided with a neck 2 having on its peripheral wall an annular groove 3. To facilitate the positioning of the closing device 4 the external wall of the neck essentially has the shape of a cone, the diameter of which progressively decreases along the axial direction away from the annular groove 3 and towards the extreme rounded rim 5.

The closing device 4 consists of two interlocking pieces, namely a dispensing cap 6 and an obturator member 7. The dispensing cap 6 and the obturator member 7 are each produced in a single piece by moulding an elastically deformable plastic.

The dispensing cap 6 is essentially a body of revolution around an axis which is identical to the axis of the neck of the container. An external skirt 8 makes it possible to fix the dispensing cap 6 onto the neck 2 of the container by snapping-on. The means for snapping-on the external skirt 8 consist, in this illustrative embodiment, of a radially inwardly projecting snap-on bead 9 which engages inside the annular groove behind (i.e. below) the apex of the conical exterior of the neck 2 of the container 1. The external skirt 8 is connected, by means of an annular planar shoulder 10, to a dispensing nozzle 11 projecting axially beyond the neck. The annular shoulder 10 is essentially perpendicular to the external skirt 8 and bears on the extreme rounded rim 5 of the neck 2.

The dispensing nozzle 11 is provided with an axial channel which communicates the internal volume of the container with a discharge orifice 12 at the free end of the nozzle 11. The nozzle 11 is in the shape of a glove finger the axis of which is essentially identical to that of the neck 2 of the container when the nozzle 11 is not subjected to any mechanical stress. An internal skirt 13 prolongs the wall of the nozzle 11 into the neck of the container 1. The internal skirt 13 and the external skirt 8 are essentially coaxial. Two coaxial peripheral lips 14 are provided in relief on the external wall of the internal skirt 13. The seal between the external wall of the internal skirt 13 and the internal wall of the neck 2 is ensured by the tight gripping of the two peripheral lips 14.

The dispensing nozzle 11, constituting the movable part of the dispensing cap 6 is joined, by means of an elastically deformable peripheral wall zone 15, to the fixed part of the dispensing cap comprising on the one hand the external and internal coaxial skirts 8 and 13, respectively, and on the other hand the annular shoulder 10. The elastically deformable wall zone 15 is located near the zone in which the nozzle 11 is connected to the annular shoulder 10. As shown in the drawing, the nozzle 11 has its deformable zone 15 defined by a narrower cross-section having both a smaller diameter and a lower wall thickness than the rest of the nozzle 11.

Part of the obturator member 7 is housed inside the axial channel in the nozzle 11 and part is housed inside the internal skirt 13. The obturator member 7 is in the shape of a cylinder of revolution having its axis essentially identical to the axis of the dispensing cap 6. The side wall of the obturator member 7 essentially matches the internal side wall of the nozzle 11 and that of the internal skirt 13. The obturator member 7 mainly comprises three successive sections, namely a cylindrical plug 7*a*, an intermediate part in which a peripheral groove 7*b* is located, and a ribbed part 7*c*. The cylindrical plug 7*a* comprises two sections of different diameters, delimiting a shoulder or step 24 therebetween. This shoulder cooperates with a conforming wall zone of the interior of the cap 4 in order to locate the obturator member 7 axially in the dispensing cap 6, and to prevent expulsion due to the internal pressure in the container. The larger diameter section of the cylindrical plug 7*a* is pressed inside a cylindrical cavity delimited by the internal skirt 13. A radially inwardly extending peripheral bead 25 on the free end edge of the internal skirt 13 locates the obturator member 7 and holds it against movement inwardly of the container.

A rectilinear groove 16, which is essentially parallel to the axis of the obturator member 7, is located in the plug 7*a*.

The rectilinear groove 16 emerges at one of its ends inside the container 1 and at its other end inside the peripheral groove 7*b* in the obturator member. The peripheral groove 7*b* extends concentrically around the axis of the obturator member 7 and has its cross-section in the shape of a rounded curve; its maximum depth, measured perpendicular to the axis of the obturator member 7, is small relative to the axial distance between its two peripheral edges. The zone in which the groove 7*b* is located constitutes the cross-section of smallest diameter of the obturator member 7 and is elastically deformable. Thus if the nozzle 11 is tilted the plug 7*a* positioned inside the neck remains essentially fixed, and the obturator member 7 can, by virtue of its elasticity, be bent in its zone of smallest diameter to swing about a diametral axis in the median plane of the peripheral groove 7*b*.

The deformable peripheral wall zone 15 of the nozzle closely matches the groove 7*b* in the obturator member and thus ensures the leaktight closure of the container when the nozzle 11 is not actuated. The ribbed part 7*c* of the obturator member 7 terminates in a rounded end 17 closely spaced from the discharge orifice 12 of the nozzle 11. The diameter of the ribbed part 7*c* of the obturator member, measured at the addenda of the ribs, is essentially equal to the internal diameter of the nozzle 11. The ribs extend over the entire length of the ribbed part 7*c*, from the rounded end 17 to the peripheral groove 7*b*.

In order to dispense the product packaged inside the pressurised container 1, the user tilts the dispensing nozzle 11 by bending about a diametral axis, for example by acting in the direction indicated by the arrow 18 in the drawing. As described above, this tilting operation is made possible by virtue of the elastic deformation of the peripheral wall zone 15 of the nozzle, which wall zone normally forms the seal. During this tilting operation the obturator member 7, which is fixed by its plug 7*a* to the fixed part of the dispensing cap 1, bends in its zone of smallest cross-section, and hence of least resistance, i.e. in the zone where the peripheral groove 7*b* is located. As shown in FIG. 2, the segment of the peripheral wall zone 15 of the nozzle which is located on the side acted upon by the user, is straightened by the tilting of the nozzle 11, and this pulls it away from the wall of the groove 7*b* and creates a gap 19. The packaged product can flow through the rectilinear groove 16 and in the gap 19 to pass through the ribs of the part 7*c* of the obturator member and thus to reach the discharge orifice 12. As soon as the user eases his force, the nozzle 11 and also the obturator member 7, return to the original position shown in FIG. 1 and the peripheral wall zone 15 can again adhere in a leaktight manner to the wall of the peripheral groove 7*b* of the obturator member.

The closing device which has been described above can easily be fixed to the container 1, after the container has been filled, because it is sufficient simply to snap the external skirt 8 around the neck. In contrast to the known device, the obturator member 7 cooperates not with the neck of the container, but with the wall of the nozzle 11 itself in order to ensure the closure of the container. The presence of an internal skirt 13, which is hermetically applied against the wall of the neck 2, makes it possible greatly to improve the seal required between the closing device and the container.

I claim:

1. A closing device intended to be fixed to a container neck, such closing device consisting of a dispensing cap made of an elastically deformable material; said dispensing cap comprising:

(a) a fixed part;

(b) a movable part;

(c) means on said fixed part effective to fasten said fixed part to a said container neck;

(d) deformable wall means connecting said movable part swingably to said fixed part;

(e) means on said movable part defining a discharge orifice whereby said movable part constitutes a dispensing nozzle projecting outside the container;

(f) two ends to said dispensing cap;

(g) means defining an axial channel connecting that end of the dispensing cap which is intended to face the internal volume of the container with said discharge orifice means;

(h) obturator means consisting of an elongate body of an elastically deformable material;

(i) means fixing one of the ends of said obturator body to at least one of said fixed part of the dispensing cap and said neck of the container; and (j) means defining an externally concave intermediate zone of said obturator body between the ends thereof;

wherein said deformable wall means joining the dispensing nozzle to said fixed part of the dispensing cap surrounds said intermediate zone of the obturator means and forms a seal therewith when said dispensing nozzle is in a first position with said deformable wall means unstrained, whereby swinging of the dispensing nozzle about a transverse axis breaks said seal so that the dispensing operation can be carried out.

2. A closing device according to claim 1, wherein the dispensing cap is in the form of a cylinder of revolution about an axis and the said means on said fixed part effective to fasten said fixed part to a said container neck is formed such that the axis of generation of said fixed part will be substantially identical to that of the neck of a said container when the cap is fixed to the neck.

3. A closing device according to claim 1, wherein said deformable wall means which forms the seal has a cross-section whose internal diameter is smaller than that of the remainder of said dispensing nozzle, said cross-section engaging said externally concave intermediate zone of the obturator means and having a shape conforming therewith.

4. A closing device according to claim 3, wherein said dispensing nozzle has its said deformable wall means thinner than the remainder of its wall zone thereby enhancing the deformability of said deformable wall means.

5. A closing device according to claim 3, wherein the said externally concave intermediate zone of the obturator means defines a peripheral groove in the shape of a rounded curve, said peripheral groove having a maximum radial depth which is small relative to the axial distance between the two peripheral edges of the said peripheral groove.

6. A closing device according to any one of claims 1 to 5, wherein said means on fixed part of the dispensing cap effective to fasten said fixed part to a said container neck includes an external skirt adapted to be fixed around the outside of the neck of a said container by snapping-on; and including an annular shoulder joining said external skirt to the said dispensing nozzle.

7. A closing device according to claim 6, wherein said deformable peripheral wall zone of the nozzle is located near the said annular shoulder and to the side of said annular shoulder which in use of the device faces the outside of the neck of a said container on which the device is to be mounted.

8. A closing device according to claim 7, wherein said means on said fixed part effective to fasten said fixed part to a said container neck includes an internal skirt of the cap intended to bear on the internal wall of the neck of a said container; and wherein said obturator means includes, at one of its ends, a mounting plug of cross-section larger than that of the rest of the obturator means, said mounting plug being pressed into said internal skirt of the cap.

9. A closing device according to claim 8, wherein said internal skirt has at least one deformable peripheral lip on its radially outer surface to form a seal with the neck of a said container.

10. A closing device according to claim 8, wherein said mounting plug of the obturator means includes means defining at least one groove which extends parallel to the longitudinal axis of the obturator body and opens at one of its ends at the end of said obturator means nearer the inside of the container and at its other end at said externally concave intermediate zone of the obturator body.

11. A closing device according to claim 10, wherein a part of the obturator body between the said externally concave zone and an end of the obturator means located near the said discharge orifice means is provided with ribs extending parallel to the axis of the said obturator body, and wherein the diameter of the obturator body measured between the addenda of the ribs is substantially equal to the internal diameter of the said dispensing nozzle at the part of the nozzle which surrounds the said ribbed part of the obturator body.

12. A pressurised container for packaging and dispensing a liquid product and comprising a neck having a closing device according to any one of claims 1 to 5 mounted sealingly thereon.

13. A pressurised container for packaging and dispensing a liquid product and comprising a neck having a closing device according to claim 6 mounted sealingly thereon, wherein said annular shoulder bears against the rim of the neck of the container.

* * * * *